United States Patent [19]

Hawkins

[11] Patent Number: 4,480,872

[45] Date of Patent: Nov. 6, 1984

[54] MODIFIED STRIP MINING APPARATUS

[76] Inventor: Walter H. Hawkins, 3224 N. Bournewood Ave., Bowling Green, Ky. 42101

[21] Appl. No.: 230,011

[22] Filed: Jan. 30, 1981

[51] Int. Cl.[3] ..... E21C 9/08

[52] U.S. Cl. ..... 299/56; 299/18; 299/58; 299/3

[58] Field of Search ..... 299/33, 56, 55, 58, 299/18, 19, 30, 11

[56] References Cited

U.S. PATENT DOCUMENTS

| | | | |
|---|---|---|---|
| 2,719,708 | 10/1955 | Compton | 229/56 |
| 2,722,409 | 11/1955 | Bergman | 299/56 |
| 2,955,808 | 10/1960 | Kandle | 299/56 |
| 4,014,574 | 3/1977 | Todd | 299/30 |
| 4,017,122 | 4/1977 | Simpson | 299/19 |
| 4,059,163 | 11/1977 | Stedman | 299/18 |
| 4,121,673 | 10/1978 | Cherrington | 299/33 |
| 4,280,732 | 7/1981 | Haspert | 299/18 |

*Primary Examiner*—William F. Pate, III

[57] ABSTRACT

An apparatus for strip mining using a power section driven into the cool and a conveyor section to transport the mineral out of the cut. The power section comprises a power driven cutter blade and conial flighting to convey the mineral to a conveyor belt in the conveyor section.

5 Claims, 18 Drawing Figures

MODIFIED STRIP MINING APPARATUS

BACKGROUND OF THE INVENTION

1. Field of the Invention

The present invention relates to a method and apparatus for coal mining, and more particularly, relates to a method and apparatus which would provide an improved strip mining method, reducing the land surface and overburden disturbed thereby compared to the conventional strip mining method.

2. General Background and Prior Art

It is a known fact in strip mining of coal, that because of the present methods in strip mining, the land mined thereby is reduced to a non-usable state, in all cases being stripped completely of any vegetation, and the result being massive cuts into the surface of the land which is very unsightly, unable to support any type of vegetation or animal growth, and, susceptible to allowing rain water to run off, thus, increasing the likelihood of flooding and erosion in the area around the strip mining. Also, the present method of strip mining requires the complete removal of topsoil and overburden across the face of the mined land, and very inefficiently collects the coal from the stripped surface, placing it in haulers for hauling out of the area. In terms of the time and great costs of the massive machinery for overburden removal measured against the amount of coal contained in this present method, improvements are very vital, especially in the present energy crisis, coal is being looked upon as the most promising alternative source to the oil and gas crisis, and it is imperative that the method of mining same be made more efficient, coupled with the ability to render the land where the coal has been mined, less detrimentally effected by said mining.

In the present state of the art, several patents have been obtained in regard to mining coal. However, very few patents have been obtained in the art that deals specifically with exterior strip mining in coal. For example, U.S. Pat. No. 4,014,574, entitled "Mining Machine Having Rectangular Thrusts Transmitting Conveyor Column", issued to R. E. Todd, this patent would teach the use of a mining machine having a laterally elongated cutting head means for cutting an earth formation, in laterally elongating thrusts transmitting column connected to and extending rearwardly from the cutting head, and a power head connecting to the rear of the column. It should be noted that the method would depend on the roof of the hole being supported by pillars and a bridging effect. Also, it should be noted that the use of this machine is via screw augers for removing coal, and the power head as shown in the patent, lacks the maneuverability of the free crawler to reposition for the next boring.

Also, in the present state of the art for auger methods of strip mining coal, the augers are used only for that portion of the coal bed unavailable to conventional strip mining methods, due to excessive overburden depth, thus being utilized primarily for closing out an operation.

SUMMARY OF THE INVENTION

The apparatus and method of the present invention for strip mining coal and like minerals would include providing a series of strip cuts along the surface of the earth to a depth of the coal seam and mining the coal within the coal seam in a conventional manner. The coal between successive cuts would be mined by inserting into the coal seam cutter sections which would be power driven into the base of the coal seam parallel to the surface of the earth, the coal being conveyed back through the power section on to successive sections until the coal would reach the cut for depositing on to haulers. Each section would be further provided with reinforcement means, and means for allowing reduced friction and movement of the section into the face of the coal seam. Also would be provided means for interlocking the section for insertion into and removal from the coal seam. The method and apparatus would also include the means for receiving the transported coal from the coal seam and depositing same into haulers. In the method, the overburden from each successive cut would be filled into the cut that has been mined. This method of inserting sections into the face of the coal seam would be repeated throughout the length of the cut on both sides of the cut, with the land above the coal seam eventually settling to a degree of the displaced coal.

Therefore, it is an object of the present invention to provide a method for strip mining coal by reducing the amount of stripped land by 80%.

It is the further object of the present invention to provide a method for strip mining coal by providing a series of cut, the over-burden from each successive cut filling the previously lined cut.

It is the further object of the present invention to provide a method for strip mining coal which would allow mining the coal from the coal seam without the necessity of removing the overburden in the process.

It is therefore a further object of the present invention to provide an apparatus for mining coal which would be self-supporting as the coal is mined beneath the overburden of the seam.

It is therefore a further object of the present invention to provide an apparatus for mining coal without having to provide for "pillars" of coal as support between successive mine sections.

It is a further object of the present invention to provide an apparatus for mining coal which would allow for transporting the coal from the various sections of the apparatus rearward for removal of the coal from the seam.

It is a further object of the present invention to provide an apparatus and method ofmining which could be utilized for several minerals mined, such as coal.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
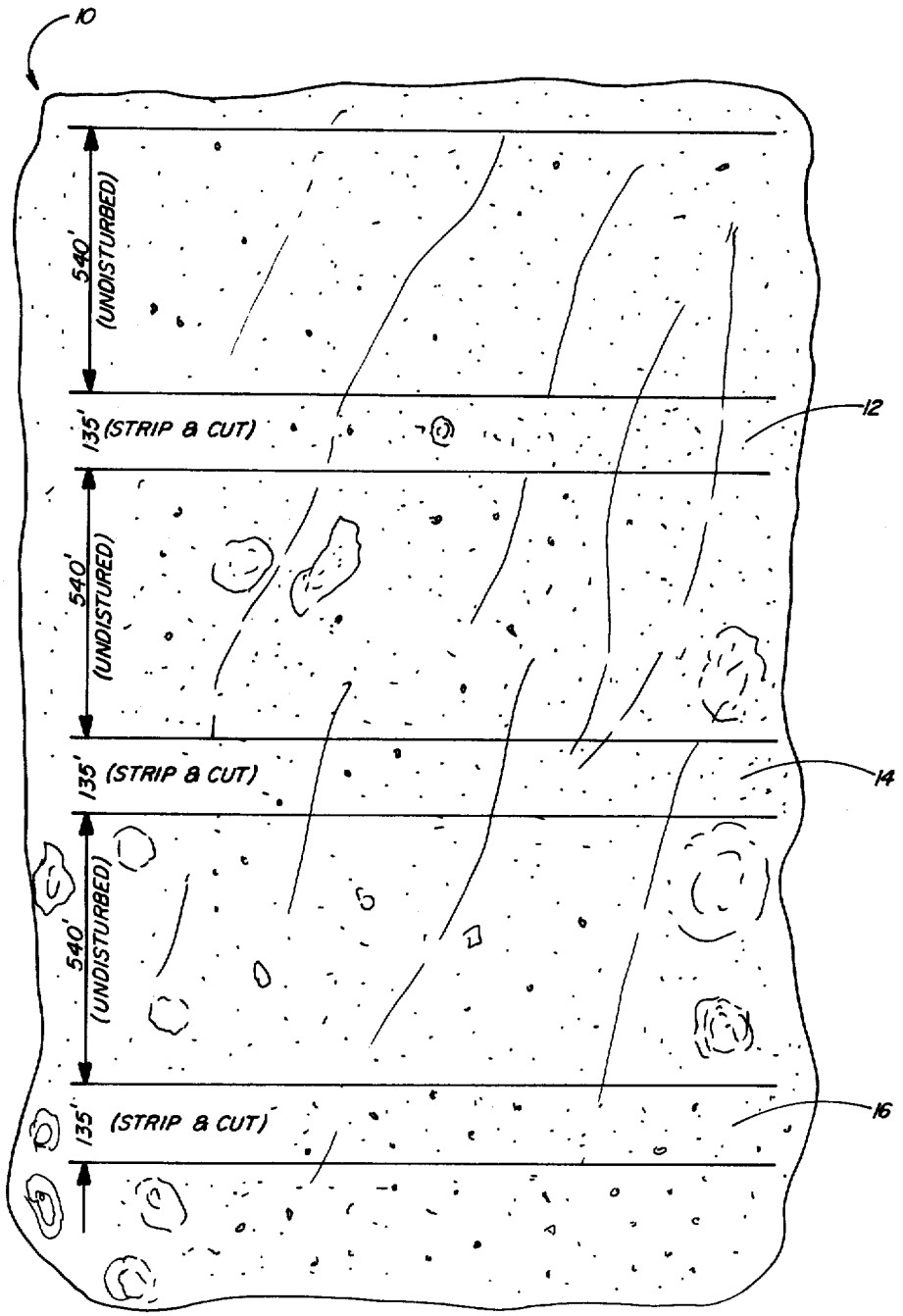
FIG. 1 is an overall view of the land area involved in the strip mining method and apparatus of the preferred embodiment of the present invention.

FIG. 1 of the method and apparatus of the present invention would illustrate a view of the land involved in a strip mining operation generally designated by numeral 10. Sections of land 10 would include strip cuts 12, 14 and 16, each cut, in the preferred method being approximately 135 feet in width and cut along the entire length of section of land 10. Preferably, cut 12 would be approximately 540 feet from parallel cut 14 and each succeeding cut 540 feet in distance away from the next cut. Thus, of the entire section of land involved in this strip mining method, only approximately 25% of the land 10 is actually stripped away on the surface.

Figure 2:
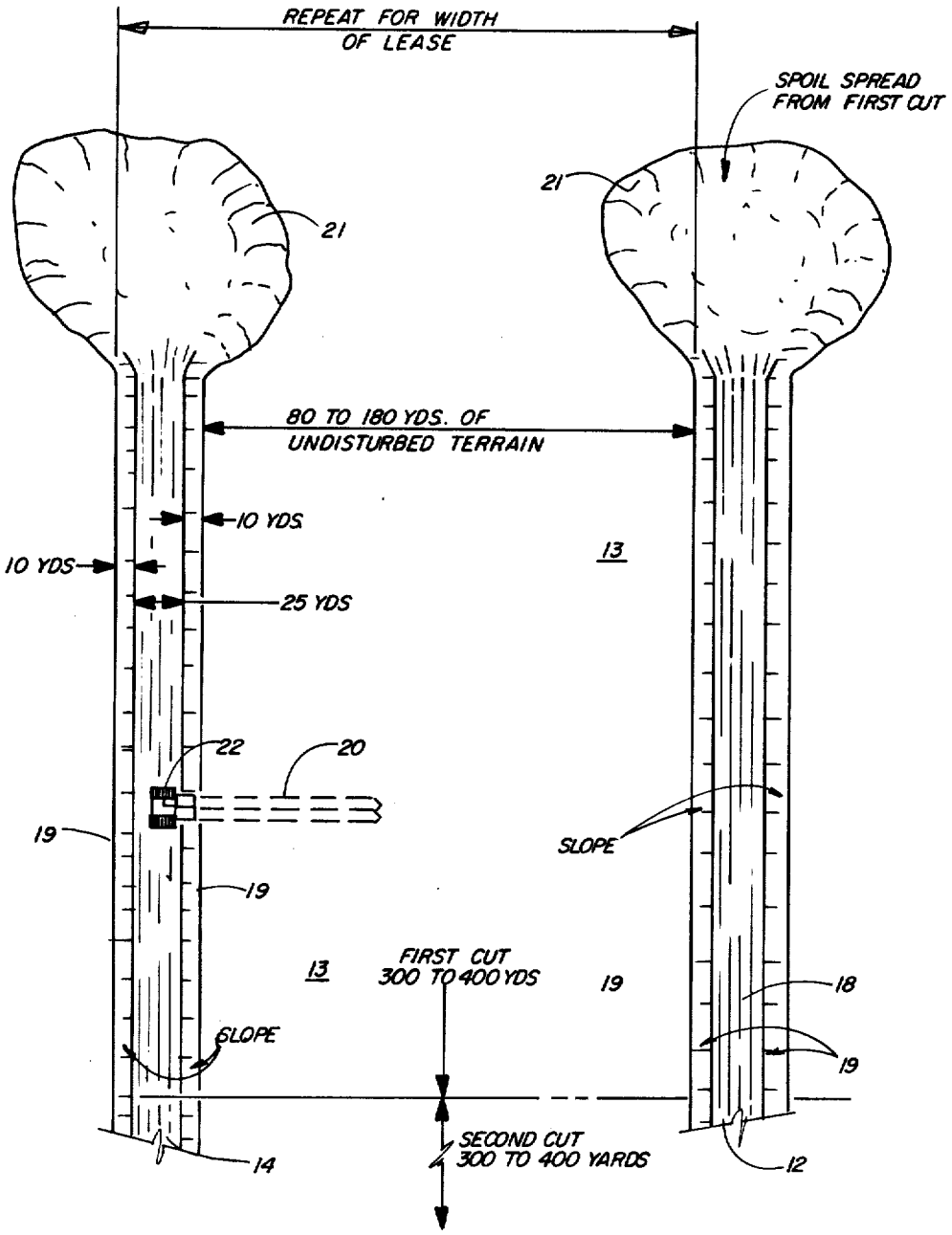
FIG. 2 is a top view of a cut made into the face of the earth in the preferred embodiment of the method of the present invention.

FIG. 2 illustrates an overall view of the method of the present invention illustrating a pair of strip cuts 12 and 14 respectively, having bottom surfaces 18 and sloping sides 19. The slope of side 19 would be approximately of the degree to prevent cave-in. Ends of cuts are sloped to allow haulers to enter and leave cut. Further illustrated in FIG. 2 is spoil spread 21 which is deposited at the end of cut 12 and 14. As will be illustrated further, the spoil spread from a cut will be redeposited in to the previously mined cut. In the preferred embodiment, as illustrated in FIG. 2, cutter assembly 20 are illustrated in phantom as they have been inserted into the undisturbed terrain 13 between cuts. This process will be further illustrated in subsequent figures. As is seen in FIG. 2, cutter assembly 20 would be thrust into the undisturbed terrain with the use of powered vehicles 22, preferably of the size of DC10's or the like units.

Figure 3A:
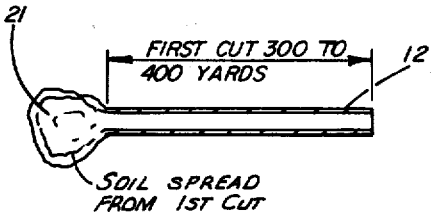
FIGS. 3A and 3B are overall views of a first and second cut made purusant to the preferred embodiment of the method of the present invention, illustrating the removal of overburden from the second cut and depositing into the first cut.
Figure 3B:
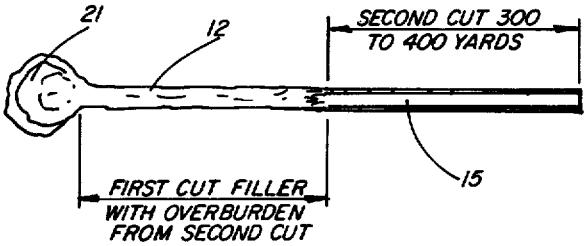

FIGS. 3A and 3B are views of a strip cut, for example 12, wherein the overburden has been deposited in initial cut 12 in spoil spread 21. As is illustrated in FIG. 3B, as cut 12 is extended further, and the first section of cut 12 has been mined, the overburden from the second section 15 of cut 12 is deposited into the first section, thus, in this preferred method, allowing for recovery of the soil, as each succeeding section of cut is mined.

Figure 5:
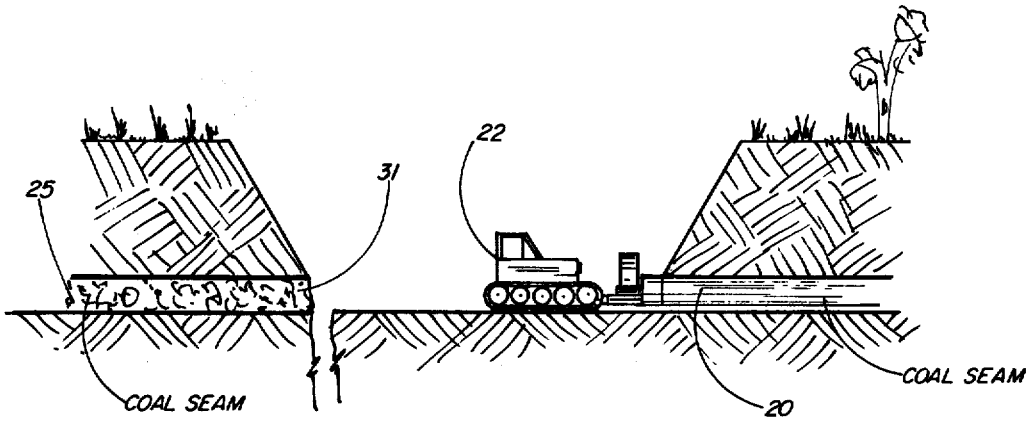
FIG. 5 is a side view of the method and apparatus of the preferred embodiment of the present invention illustrating the insertion of the cutter section into the coal face.
Figure 4:
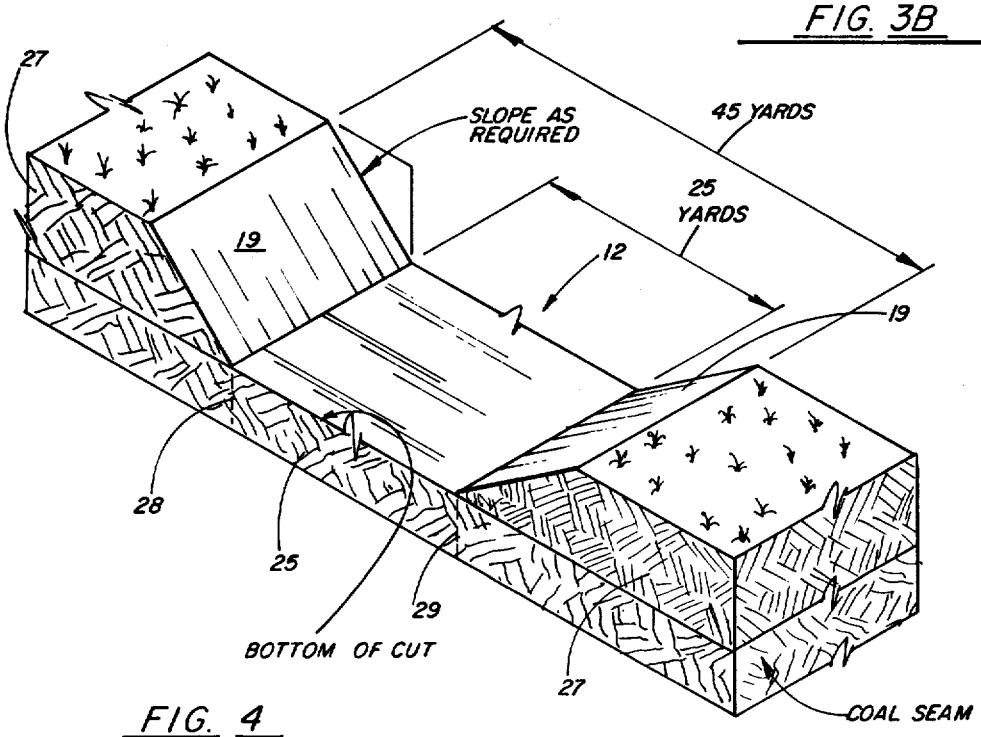
FIG. 4 is a perspective sectional view of the preferred embodiment of the present invention, illustrating the typical cut made into the earth.

FIG. 4 illustrates a perspective sectional view of a typical cut in the preferred method of the invention. The top side of cut 12 is indicated as being approximately 45 yards in width, with the bottom side being approximately 25 yards in width, thus, providing for the necessary slope 19 as required for stability of overburden 27. FIG. 4 further illustrates coal seam 25 which, in the preferred embodiment would be reached by conventional removal of overburden 27, thus, exposing the coal seam 25 on the bottom surface of the cut 12 after the overburden 27 has been removed. As illustrated in FIG. 4, the coal seam at the bottom of the cut, would then be mined in a conventional manner, between the dotted lines 28 and 29, thus, as seen in FIG. 5, exposing the side wall 31 of the coal seam 25, for beginning the actual utilization of appartus and method in this preferred embodiment of the invention. As can be seen in FIG. 5, powered vehicle 22, in position for thrusting cutter assembly 20 into the face of the coal seam 25. In the preferred method, cutter assembly section 20, which will be illustrated in further detail in subsequent figures, would be approximately of a size somewhat less, than the height of the coal seam, in order to assure that the insertion of the cutter assembly section 20 of the coal seam is inserted only in to coal and not in to surrounding overburden 27, which would create impurities in the coal removed therefrom. It should be made clear that in accomplishing the method of the present invention it is necessary to clearly understand the structure and the inner connection of the structure of the apparatus of the present invention.

Figure 6:
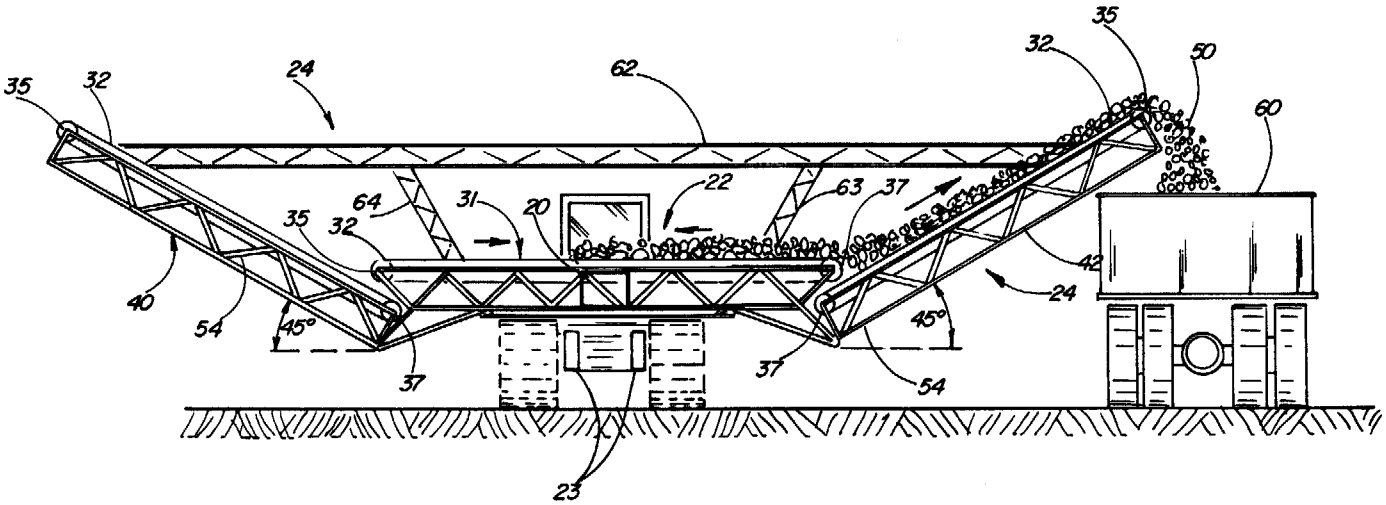
FIG. 6 is a view of the receiver section of the preferred embodiment of the apparatus of the present invention receiving coal from the coal face and depositing thereto into haulers.
Figure 7:
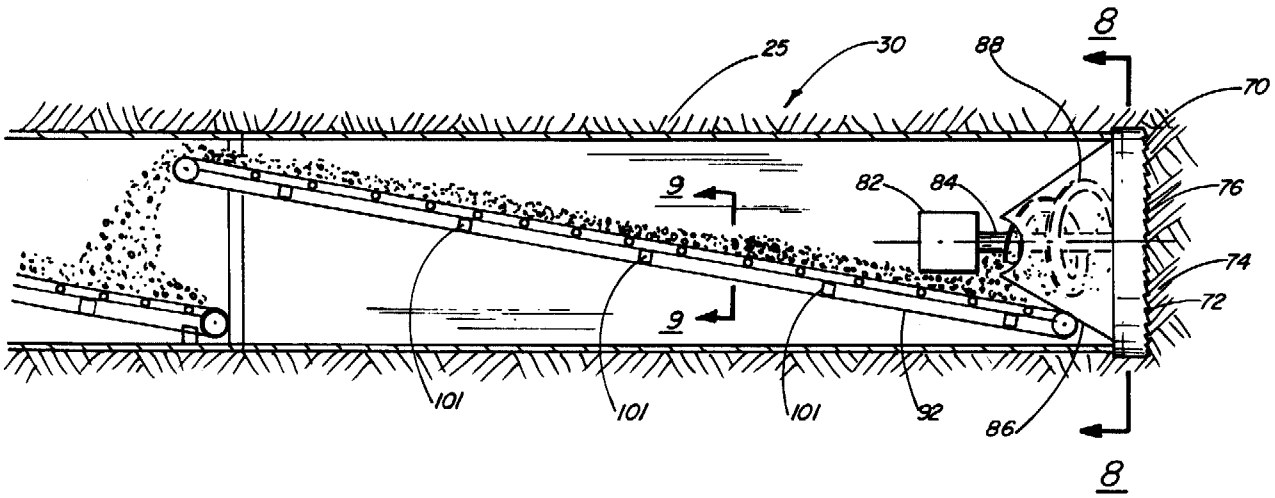
FIG. 7 is a side view of the cutter section and a partial view of the successive section of the preferred embodiment of the apparatus of the present invention illustrating the cutting of coal and the delivery therefrom the cut back through the section.
Figure 10:
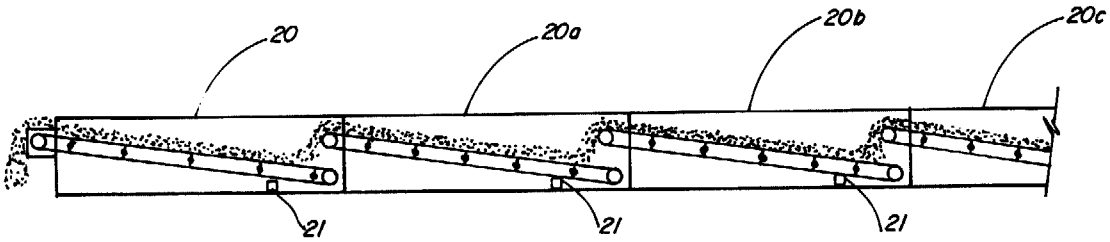
FIG. 10 is a overall view of successive sections contained within the coal face of the preferred embodiment of the apparatus of the present invention illustrating the transport of coal from one section to the next succeeding section and out of the entire coal face.

FIG. 6 illustrates a frontal view of a powered vehicle 22, here a tractor, having coal receiver section 24 being attached to arms of tractor unit 22 so that the hydraulic upper and lower movement of the arms 23 would be able to position the height of the cutter assembly section 20 for each particular height of the section. As illustrated in FIG. 7, cutter assembly section 20, preferably being approximately 50 feet in length, being the initial section inserted into coal face 25 would weigh as would each successive section, approximately 25,000 pounds, thus requiring that it be placed in position by a lifting means, such as, preferably, traveling bridge crane (not shown). Cutter assembly section 20, as with each successive section 20*a* (not shown) would then be attached to receiver conveyor section 24, as illustrated in FIG. 10, by means which will be further illustrated in subsequent figures. The positioning of attachment of cutter assembly section 20, to receiver conveyor section 24, is such that the transport of coal from section 20 would be onto the conveyor belt of receiver conveyor section 24 for further transport upard into haulers 60. The structure of receiver conveyor section 24, as indicated in FIG. 6, would have the central conveyor section 31 which comprises a conveyor belt 32 rotatable between conveyor wheels 35 and 37 at each end, or movement of the coal across the receiver conveyor section 24. Extending at an angle approximately 45° upward from each end of central conveyor section 31 would be the inclined conveyor sections 40 and 42 respectively for movement of the coal from central conveyor section 31 onto each inclined section 40 or 42, depending on the direction of the movement of the coal 50 which the operator needs. Each inclined conveyor section 40 or 42 would also have conveyor belts 32 rotatably movable on rollers 35 and 37 at each end. Each section 31, 40 and 42 would be supported by metal support frameworks; the entire three sections 31, 40 and 42 being attachable on to receiver conveyor section 24 as a single unit. As can be seen further in FIG. 6, receiver conveyor section 24 is further supported by an upper straddle support section 62 which, in the preferred embodiment would extend from the upper end of inclined section 40 to the upper end of inclined section 42 with the extended section 62 being further supported across its width by support sections 63 and 64. This additional structure in support of the three conveyor sections would give the added support to the inclined sections as the coal is being transported upward for depositing into hauler 60. In the preferred embodiment, the framework in the support sections would be of a typical steel framework 54, and the conveyor systems being driven by, preferably, hydraulic motors, which would be reversible for movement of the coal in either direction, depending on the positioning of the hauler.

The section being inserted into the coal face, including those sections following the cutter section 20, would be attachable to a central position of center conveyor section 31 and, as the powered vehicle 22 is thrust forward inserting the section into the coal face 25, the coal removed therefrom would be deposited on to receiving conveyor section 24 and conveyed into the coal hauler 60. In the preferred embodiment, the powering of all conveyor belt systems in this invention, would be done by suitable means, preferably by motors being hydraulically driven. It should be noted that the connection between the sections being inserted into the coal face and the receiver conveyor section 24 would be the same type of connection which will be discussed in subsequent figures, that is the rotatable L-arms coupling onto the end of the section, in such a manner, so that the coal conveyed out of the particular section connected on to receiver conveyor section 24 would be deposited onto the conveyor belts 32 of receiver conveyor section 24.

Figure 8:
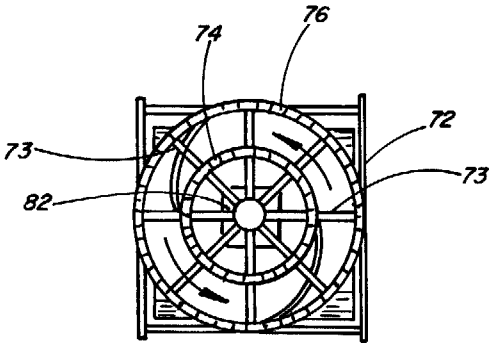
FIG. 8 is a view along lines 7—7 illustrating a frontal view of the cutter of the preferred embodiment of the apparatus of the present invention.

FIG. 7 illustrates in detail a structure of cutter section 30, after it has been inserted into coal seam 25 by powered vehicle 22. Cutter section 30 is illustrated with a sidewall being cut away to expose the inner workings of the section. On the forward end of the section is rotary cutter assembly 70, illustrated in FIG. 8, which is a pair of concentric annular blades 72 and 74, in a single plane separated by reinforcement spokes 73, and having cutter teeth 76 on the forward end continuously for cutting into the face of the coal seam 25 as cutter section 30 is inserted into the coal seam 25 on a single plane. Cutter 70, preferably, would be driven by hydraulic motor 82 interconnected thereto by shaft 84. Extending rearward from cutter assembly 70 would be conically-shaped hopper 86 for containing the coal that has been cut by assembly 70. Contained in hopper section 86 would be flighting 88, rigidly attached to shaft 84, which is conically shaped thus moving coal rearward from cutter assembly 70 and out of hopper 86 and on to conveyor belt 92 as illustrated in FIG. 7. As stated previously, conveyor belt 92 would be preferably hydraulically driven and moving the coal from the front end of section 30 to the rearward end of section 30. Further illustrated in FIG. 7 is a configuration of the support system supporting conveyor transport belt 92. The support system 101 would be comprised of a series of metal support braces 102, preferably junior I-beams, extending the width of the cutter assembly section 20 and rigidly attached to the walls thereto for supporting the conveyor rollers.

Figure 9:
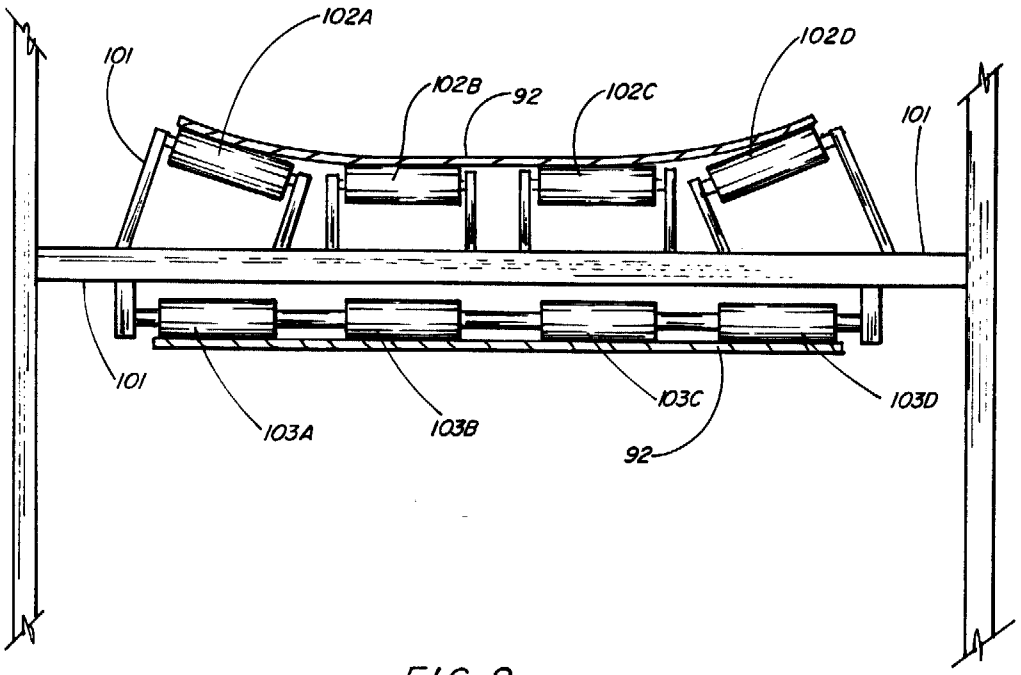
FIG. 9 is a frontal view of a conveyor section of the preferred embodiment of the apparatus of the present invention.

FIG. 9 best illustrates, along the lines of 8—8 in FIG. 7, the configuration of roller system 100.

As illustrated in FIG. 7, roller system 100 would be comprised of support system 101 positioned at increasing height from front to rear within each section, for transport of the coal 50 from the lower portion of the front of cutter section 30 to the upper rear portion of the particular section, for depositing the coal as illustrated in FIG. 7, on to the lower end of the next succeeding section. It is further illustrated in FIG. 9, the roller system 92 would be comprised of upper rollers 102 which would preferably be four across the section, with the two end rollers 102*a* and 102*d* being slightly faced inward, so that conveyor belt 100 would be conveyed on its upper section in a slightly concaved fashion for maintaining coal 50 on conveyor belt 100 during the transport along the section. Also illustrated in FIG. 9 is lower rollers 103*a* through 103*d* which would be utilized on the underside of the belt 92 being carried back for further transport of coal. All users of the belts in the particular sections, both on the sections inserted into the coal seam 25 and to the receiver section 24 would utilize this type of roller system.

FIG. 10 illustrates a side view series of sections interconnected for transporting coal out of the coal seam 25 rearward. Please note the positioning of the conveyor systems 100, 100*a*, 100*b*, and 100*c*, each system, as previously stated being hydraulically driven by an individual hydraulic motor 21 within each section, and each system having its own structural support system. The rearward end of the conveyor system extends outward from each section, so that the coal 50 is deposited on to the belt of the next section. This process is repeated, so that a minimum of coal is lost in the transport from section to section.

Figure 11:
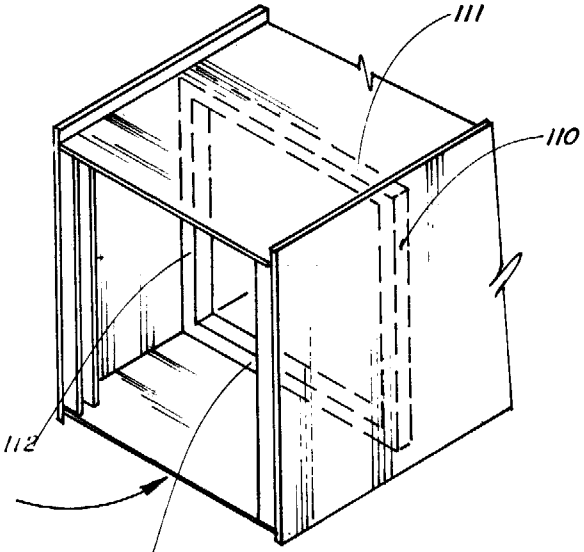
FIG. 11 is a partial view of the support framework of the preferred embodiment of the individual sections of the apparatus of the present invention.

FIG. 11 would illustrate in perspective view a portion of a typical section, with support steel I-beams 110 through 113 rigidly attached, as for example, welded, onto its inner skin. The support beams would be spaced approximately 3 to 4 feet apart so that the entire length of each section would be maintained rigid during the operation in the mining method. Also note that the structure beams are such that available space is maintained within the section for passage of the conveyor belt system carrying coal therethrough.

Figure 13:
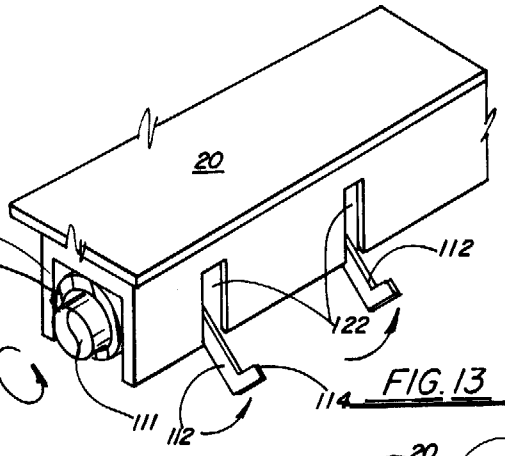
FIG. 13 is a prespective view of the connector arm assembky of the preferred embodiment of the apparatus of the present invention.
Figure 12:
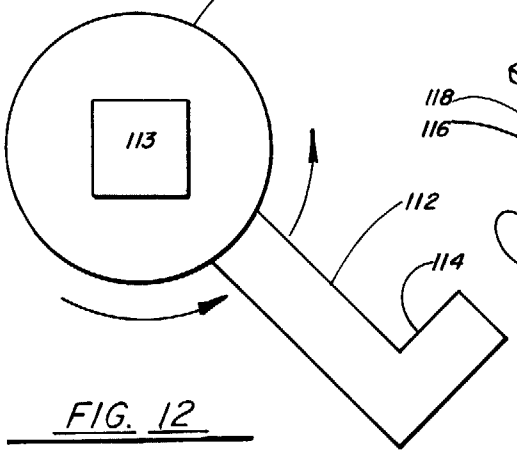
FIG. 12 is a side view of a connector arm of the preferred embodiment of the apparatus of the present invention.
Figure 14:
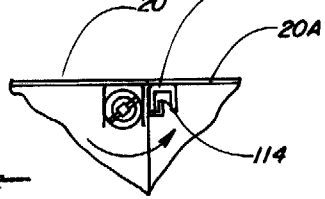
FIG. 14 is a cut away side view of the connector assembly in the locked position in the preferred embodiment of the apparatus of the present invention.

FIGS. 12-14 would illustrate in detail the locking mechanism between each section. It should be noted, that the front end of a section would have circular housing 116 securely attached at each end to the side walls of section 20, for example. Contained in circular housing 116 would be rotatable shaft 111 having arms 112, extending outward therefrom through slots 122. It should be noted that in FIG. 12 rotatable shaft 111 would have means such as a open-ended square means 113 on its end for attaching thereto a handle 114 for rotating shaft 111.

Therefore, when shaft 111 is rotated, arms 112 would move upward into a position parallel with the top and bottom respectively of each section. Also illustrated in FIGS. 12–14 would be the rearward end of the preceeding section 20*a*, for example, having receiving U frames 124 along its top and bottom, so that when sections 20 and 20*a* are joined, and rotatable shaft 111 is rotated, arm 112, as illustrated in FIG. 12, would be engaged into conveyor section 20*a*, thus providing for means for securedly attaching successive sections to one another. It should be noted that in the preferred embodiment, once rotatable arms 112 have been placed in position, they are held there by means of cotter pins or the like locking devices so that once the sections have been joined during the mining process, they are securely held fast to one another during the entire mining process. FIG. 13 also illustrates U support 118 as it would be rigidly attached to the skin of a section, for example 20*a*, for containing circular housing 116 and rotatable shaft 111 therein. It should be noted that U support 118 could also contain slots 122 for allowing the rotation of arms 112 for being placed into the locked and unlocked positions.

Figure 16:
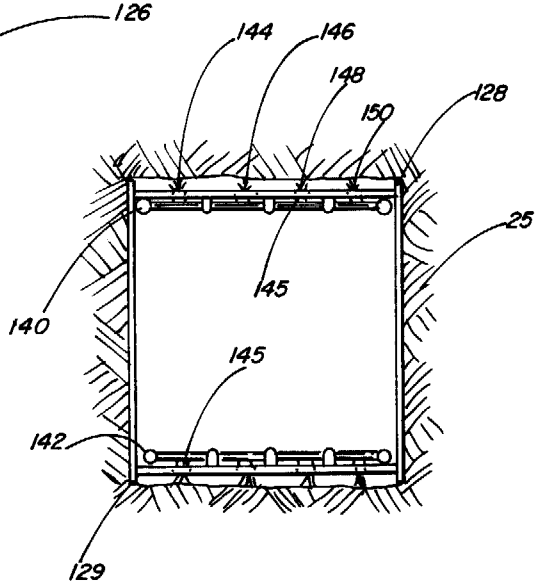
FIG. 15 through 17 illustrates the pressurized fluid assembly of the preferred embodiment of the present invention.
Figure 17:
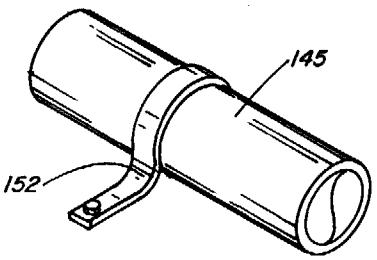
Figure 15:
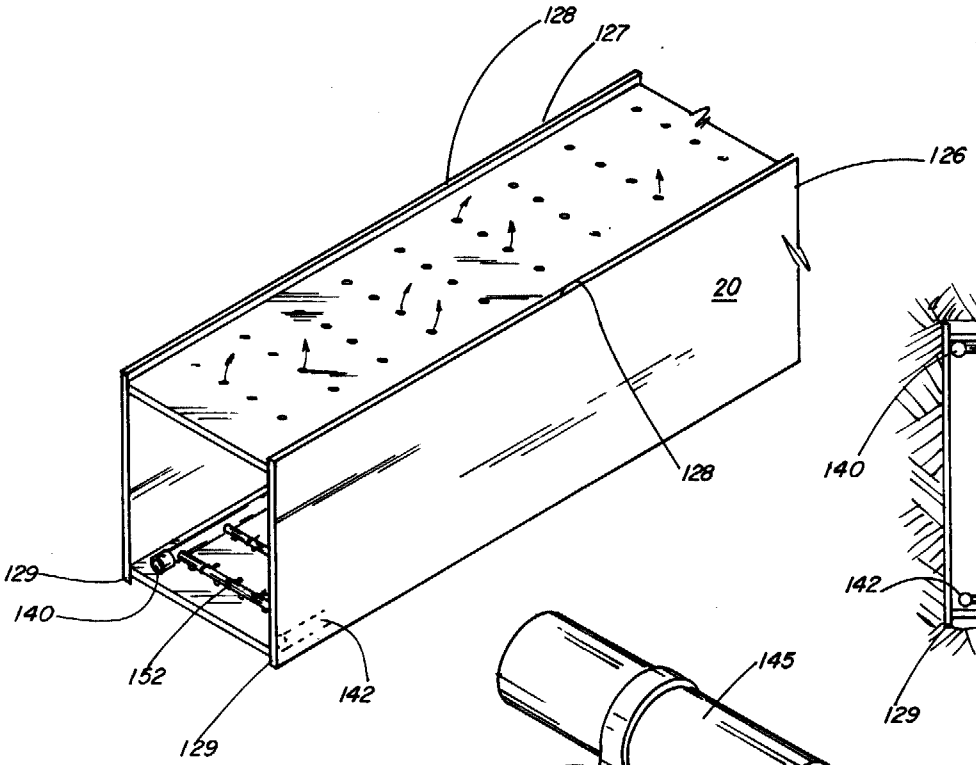

FIGS. 15 thru 17 illustrates another feature of each section of the apparatus of the present invention, illustrating the structure of side walls 126 and 127 having extention sections 128 and 129 on the bottom and top respectively. Each conveyor section for example, used in the mining process, would be adapted with a pair of air lines 140 and 142 running along the entire length and leading into individual air inserts 144, 146, 148 and 150 for transport of pressurized air along the top and bottom of each section as indicated by support brackets 152 along the entire length of the section shown in FIG. 15. Therefore, as illustrated in FIG. 16, the structure of side walls 126 and 127 with extentions 128 and 129 on top and bottom become an important feature in the apparatus, as illustrated in FIG. 16, so that when the section is inserted into the coal seam 25, the pressure of the air against the coal face would help in reducing the friction between the section and the surrounding coal on top and bottom. The structure of the side walls with extention sections 128 and 129 on bottom and top would serve as a capturing means for the air along the top and bottom of the section, therefore reducing the possibility that the air will simply disburse outward from the section and instead will be maintained within the confines of the top and bottom wall of each section.

FIG. 17 illustrates in blowup view a typical support bracket 152 as it would be onto the top and bottom skin of each section in the preferred embodiment. Seen in FIG. 17, the air lines 140–145 intersecting each air line would be secured to the skin of section by the racket 152 so that those kind of air lines would be held securedly against the skin, and not interface with the conveyor system within each section. It should be made clear that the air provided under pressure would be originated from the source outside of the coal seam 25, and as each section is attachable to another, air lines 140 and 142 would also be attached thereto for completion of the air transport throughout the entire length of the sections during the mining operation. Also in and out hydraulic lines are connected at each segment for hydraulic power from external source to power hydraulic motors. In the preferred embodiment it should be made clear that sections, as utilized in the mining method and apparatus of the present invention, depending on the thickness of the coal seam 25, would have the ability to be placed on top of one another or side by side, if the necessary thrusting could be provided by the tractor powered vehicle 22, or sections may be mined in tandom or in groups, for maximum efficiency and removal of the coal from the coal seam 25.

This method and apparatus of the present invention, clearly illustrates that the coal mined is mined from an underground operation of most of the land involved, thus the undisturbed portions would simply settle after the mining has been completed, and a minimum of wear and tear to the land would be accomplished.

Further, this particular apparatus and method could be utilized in many various minerals, in addition to coal, wherein the procedure as developed could be followed.

What is claimed as invention is:

1. An apparatus for mining coal, comprising:

a. at least a cutter section having a substantially rectangular protective casing, said protective casing being reinforced and generally comprising four walls defining a space therethrough;

b. a cutter blade assembly rotatably mounted on the first end of said section for cutting into the coal to be mined, said cutter blade assembly generally comprising a first annular blade of substantially circumferential shape as said protective casings and having a second blade defining a single plane for cutting into the coal face;

c. a hydraulic motor for rotating said cutter blade assembly;

d. a shaft inter-connecting said hydraulic motor into said cutter blade assembly for rotating said cutter blade assembly when said hydraulic motor is operating;

e. connical flighting connected to said shaft for conveying coal from said cutter blade assembly rearward;

f. at least a second section attachable to the rear of said cutter section, comprising:

i. reinforcement walls defining a rectangular open area therewithin;

ii. a conveyor belt assembly extending from the lower front of said section to the upper rear of said second section for conveying coal therethrough;

iii. a means for attaching said second section to said first section, said means comprising rotatable arms for locking into a substantially u-shaped channel of said first section;

g. air pressurized means for reducing the friction between the outer surface of said upper and lower walls of said section, said pressurized air exiting said section through a plurality of ports and forming a frictionless layer between said earth and said upper and said lower walls of said section;

h. a conveyor belt assembly, said assembly generally comprising an endless conveyor belt extending from the rear of said conical flighting upper to the rear of said protective casing, and being mounted on a series of rollers powered by a hydraulic motor;

i. means for attaching said first section to a subsequent second second, said means comprising:

i. a plurality of connector arms moveable from a first unlocked position to a second locked position;

ii. a generally u-shaped channel, located on said subsequent section for receiving said connector arms in the locked position;

iii. a handle-like insertable into said connector arm assembly for rotating said arms into said locked position;

iv. cotter pins or the like for manually locking said arms into said locked position;

j. a pressurized fluid means for reducing the friction between the outer surface of said upper and lower walls of said section and the adjacent earth, comprising:

i. a source of compressurized air, said source being located outside of said section;

ii. a means for transporting said pressurized air from said source to the protective casing of said section;

iii. a plurality of ports located on the top and bottom of the protective casing of said section, said ports serving as an exit point for said pressurized air;

iv. a means for maintaining said pressurized air within the area between said upper and lower ports of said protective casing and the adjacent earth.

2. An apparatus for mining coal comprising:

a. at least one cutter section, said section having a protective casing;

b. a cutter blade assembly rotatably mounted on the front end of said cutter section for cuttting into the coal;

c. a means for attaching subsequent sections to the rear end of said first cutter section, said means comprising:

i. a plurality of arms moveable from a first unlocked position to a second locked position, said arms located at the front end of said subsequent section;

ii. a means for receiving said arms in said locked position, said receiving means being located at the rear end of said first section;

iii. a means for moving said arms from a first unlocked position to a second locked position; and iv. a means for maintaining said arms in said locked position;

d. a power means for rotating said cutter blade assembly;

e. a means interconnecting said power means to said cutter blade assembly for rotating said cutter blade assembly during operation;

f. a conical flighting connected to said interconnecting means for conveying coal rearward from said cutter blade assembly;

g. a conveyor belt assembly, mounted within the protective casing to said cutter section for conveying coal from the rear of said conical flighting to the rear of said cutter section;

h. a pressurized fluid means for reducing the friction between the outer surface of said section and the earth adjacent said outer surface of said cutter section.

3. The apparatus of claim 2, wherein said connector arms are mounted onto a rotatable shaft contained in a substantially circular metal casing, and said means for receiving said connector arms in said locked position comprise a U-shaped metal channel extending the width of said protective casing and rigidly attached thereto.

4. The apparatus of claim 2, wherein said pressurized fluid means comprises:

a. a source of compressurized air, said source being located outside of said protective casing;

b. a means for transporting said pressurized air from said source to said protective casing;

c. a plurality of ports located on the top and bottom of said protective casing, said ports serving as an exit point for said pressurized air;

d. a means for maintaining said pressurized air within the area between said upper and lower ports of said protective casing and the adjacent earth, said means comprising vertical extensions of side walls of said protective casing for disallowing the escape of air alongside said side walls.

5. The apparatus of claim 2, further comprising at least a second section of protective casing, said second section comprising:

a. a reinforced four-walled protective skin defining an opening therethrough;

b. a conveyor belt assembly contained within said section said assembly comprising:

i. an endless belt extending from the lower first end of said section to a point rearward beyond the upper rear end of said second section;

ii. roller means located between the upper and lower level of said belts, for allowing movement of said belt along the continuous track;

iii. means for rigidly attaching said roller means to the walls of said section;

iv. a hydraulic motor for powering said conveyor belt during operation;

c. means for attaching said second section to said first section and to a subsequent section, said attaching means comprising:

i. connector arms moveble from a first unlocked position to a second locked position;

ii. a U-shaped receiving channel for receiving said connector arms while in the locked position;

iii. a means for moving said arms into said locked position;

iv. a means for maintaining said connector arms in said locked position;

d. a pressurized fluid means, for reducing the friction between the outer surface of said upper and lower walls of said section, said pressurized means comprising:

i. a source of compressurized air, said source being located outside of said protective casing;

ii. a means for transporting said pressurized air from said source to said protective casing;

iii. a plurality of ports located on the top and bottom of said protective casing, said ports serving as an exit point of for said pressurized air;

iv. a means for maintaining said pressurized air within the area between said upper and lower ports of said protective casing and the adjacent earth.

* * * * *